US012072163B2

(12) United States Patent
Herring et al.

(10) Patent No.: US 12,072,163 B2
(45) **Date of Patent: *Aug. 27, 2024**

(54) AMMUNITION CONVERTIBLE FIREARM

(71) Applicant: Ares Defense Systems, Inc., Melbourne, FL (US)

(72) Inventors: Geoffrey A. Herring, Melbourne, FL (US); Angela M. Vazquez, Springfield, MA (US); Jason Winderweedle, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/071,250

(22) Filed: Nov. 29, 2022

(65) Prior Publication Data

US 2023/0097660 A1 Mar. 30, 2023

Related U.S. Application Data

(63) Continuation of application No. 17/396,387, filed on Aug. 6, 2021, now Pat. No. 11,543,199, which is a (Continued)

(51) Int. Cl.
*F41A 9/37* (2006.01)
*F41A 3/66* (2006.01)

(Continued)

(52) U.S. Cl.
CPC ..... *F41A 9/37* (2013.01); *F41A 3/66* (2013.01); *F41A 3/84* (2013.01); *F41A 9/71* (2013.01);

(Continued)

(58) Field of Classification Search
CPC ..... F41A 3/66; F41A 3/84; F41A 9/37; F41A 9/71; F41A 17/40; F41A 17/42; F41A 19/44; F41C 7/00; F41C 23/16

(Continued)

(56) References Cited

U.S. PATENT DOCUMENTS 6,481,144 B1 * 11/2002 Chee ..... F41A 17/00 89/14.05
7,131,228 B2 * 11/2006 Hochstrate ..... F41C 23/16 42/75.01

(Continued)

*Primary Examiner* — Bret Hayes
(74) *Attorney, Agent, or Firm* — David O. Simmons; IVC Patent Agency

(57) ABSTRACT

A firearm as disclosures herein comprises a main receiver body, a barrel, a breech bolt structure, a buffer assembly, a trigger group assembly, a bolt catch and at least one of an auto-sear, a magazine adapter and a breech bolt anti-rotation structure. The main receiver body is preferably of a monolithic construction whereby the handguard and breech bolt carrying bore can be manufactured from a single piece of material. The auto-sear is tripped by engagement with a buffer of the buffer assembly. The magazine adapter has an exterior surface structure engaged with a mating interior surface structure of a magazine well space of the main receiver body. A distal end portion of the breech bolt anti-rotation structure is engageable by the buffer for limiting forward travel of the buffer when the barrel is detached from the main receiver body.

28 Claims, 5 Drawing Sheets

Related U.S. Application Data continuation of application No. 16/825,224, filed on Mar. 20, 2020, now Pat. No. 11,112,192.

(60) Provisional application No. 62/794,723, filed on Jan. 21, 2019.

(51) Int. Cl.

| | |
|---|---|
| ***F41A 3/84*** | (2006.01) |
| ***F41A 9/71*** | (2006.01) |
| ***F41A 19/44*** | (2006.01) |
| ***F41C 7/00*** | (2006.01) |
| ***F41C 23/16*** | (2006.01) |

(52) U.S. Cl.

CPC ..... *F41A 19/44* (2013.01); *F41C 7/00* (2013.01); *F41C 23/16* (2013.01)

(58) Field of Classification Search

USPC ..... 89/128

See application file for complete search history.

(56) References Cited

U.S. PATENT DOCUMENTS

| | | | | |
|---|---|---|---|---|
| 11,112,192 | B2 * | 9/2021 | Herring | F41A 9/71 |
| 11,543,199 | B2 * | 1/2023 | Herring | F41A 3/66 |
| 2009/0031607 | A1 | 2/2009 | Robinson et al. | |
| 2012/0167433 | A1 | 7/2012 | Robbins et al. | |
| 2014/0115936 | A1 * | 5/2014 | Kenney | F41G 11/003 42/16 |

* cited by examiner

AMMUNITION CONVERTIBLE FIREARM

CROSS REFERENCE TO RELATED APPLICATIONS

This non-provisional patent application claims priority as a continuation to co-pending U.S. non-provisional patent application having Ser. No. 17/396,387 filed 6 Aug. 2021 entitled "AMMUNITION CONVERTIBLE FIREARM," which claims priority to co-pending U.S. provisional patent application having Ser. No. 16/825,224 filed 20 Mar. 2020 entitled "AMMUNITION CONVERTIBLE FIREARM," now issued as U.S. Pat. No. 11,112,192, which claims priority to U.S. provisional patent application having Ser. No. 62/794,723 filed 21 Jan. 2019 entitled "MAGAZINE AND CALIBER CONVERTIBLE FIREARM WITH SIMPLIFIED PRODUCTION METHODS", these applications having a common applicant herewith and being incorporated herein in their entirety by reference.

FIELD OF THE DISCLOSURE

The disclosures made herein relate generally to firearms and methods of manufacture thereof and, more particularly, to ammunition convertible firearms that may have magazine and/or caliber conversion implemented by an end-user without the need of special gunsmith or armorer skills.

BACKGROUND

It is well known that firearms such as pistol caliber carbines or submachine guns are commonly used by law enforcement, military and civilian personnel. The Uzi, Beretta PM-12, STAR Z70B, HK MP-5, Colt 9 mm, HK UMP-45, Sig MPX illustrate examples of pistol caliber carbines or submachine guns that are used by law enforcement, military and civilian personnel. It is also well known that submachine guns can have a semi-auto pistol caliber counterpart model that is available for civilian use. The Uzi, HK MP-5, Colt 9 mm and Sig 1MPX are examples of submachine guns that have semi-auto counterpart models.

Many submachine guns can selectively fire in either semiautomatic mode or fully automatic mode. Some submachine guns (e.g., the Uzi, Beretta PM-12 and STAR Z70B) fire from an open bolt position. Other submachine guns (e.g., the HK MP-5, Colt 9 mm, HK UMP-45, Sig MPX) fire from a closed bolt position. An open bolt design typically utilizes a trigger and sear mechanism to arrest the breech bolt in the open position when the firearm is ready to fire and is generally equipped with either a fixed firing pin or a separate spring-loaded inertia striker that contains or impacts a firing pin. When the trigger is pulled on an open bolt firearm, the breech bolt is released to travel into the counter recoil position (i.e., battery position) under the stored energy of a compressed recoil spring (e.g., main action spring of a buffer assembly) and in doing so, it strips a cartridge from the magazine, feeds it into the barrel's chamber and fires the cartridge primer using breech bolt inertia via a fixed firing pin or a spring loaded inertia striker with firing pin. Open bolt firearms are generally considered to be less safe than closed bolt firearms in that the likelihood of a negligent or accidental discharge is increased with such firearms. The UZI and M11/9 are examples of the many open bolt submachine guns that are in worldwide circulation.

In contrast, a closed bolt design typically utilizes the stored energy of a compressed recoil spring to energize the breech bolt into the counter-recoil position when the weapon is manually "charged" in the recoil direction and in doing so; the breech bolt strips a cartridge from the magazine and loads it into the chamber. The breech bolt is then maintained in a counter-recoil position by the recoil spring. The cartridge is fired when the trigger is pulled by either releasing a separate spring loaded inertia striker and firing pin via a trigger sear, or it is fired by a spring loaded rotating hammer that is released from a primary sear when the trigger is pulled which then strikes the weapon's firing pin which subsequently fires the cartridge primer. Closed bolt firearms are generally considered to be safer than open bolt firearms due to less frequent accidental or negligent discharges.

Submachine guns are frequently issued to law enforcement and military personnel who have a need to operate in either confined spaces or in heavily populated areas such as cities. They are preferred in these environments due to their size, controllability, simplicity of operation and maintenance, and limited over-penetration risk compared to full-size rifle cartridges. Submachine guns are also favored in these environments because they generally exhibit greater accuracy, higher magazine capacity and longer-range effectiveness than a common issue pistol or sidearm; and they narrow the capability gap between a pistol and full-size military rifle. Additionally, pistol caliber submachine guns are easier to silence or suppress, since there is a lesser quantity of propellant gases and a greater selection of subsonic ammunition than is available for full-size rifles. Submachine guns with mounted silencers or sound suppressors are often preferred for the purposes of maintaining command control during firing, protecting user and bystander hearing, and maintaining the element of surprise during certain law enforcement and military actions.

Pistol caliber semi-auto carbines have become popular with civilian shooters for many of the same reasons that their select-fire (i.e., semi-automatic or automatic mode firing) counterpart submachine guns are selected for law enforcement and military use. They have the additional advantage for the civilian user of using more cost-effective and lower powered ammunition and are generally accepted for use in indoor ranges where full-size rifle ammunition may be prohibited due to the concussive effects of firing indoors and of potential damage to range backstops.

Submachine guns and their semi-auto counterparts frequently use higher capacity magazines than common issue pistols; such higher capacity magazines being an average of 30 rounds, whereby pistols may have an average magazine capacity of 15 rounds. The Uzi, Beretta PM-12, STAR Z70B, HK MP-5, Colt 9 mm, HK UMP-45, Sig MPX and other submachine guns, as well as their semi-auto pistol caliber carbine counterparts usually use a magazine that is different from common issue law enforcement and military pistols. Accordingly, even though a pistol may be chambered for an ammunition cartridge that is common to a given submachine gun or its semiauto counterpart, it is unlikely through the selection of available pistols and submachine guns in the global market space, that there will be interchangeability between the magazines of a pistol and those of a submachine gun or its semi-auto counterpart.

Most military, law enforcement and civilian users of submachine guns or semi-automatic, pistol caliber carbines also carry and rely on a smaller, often concealable pistol as their personal and primary handgun, generally known as a "side arm". These side arms are offered by their respective manufacturers in a myriad of caliber options including 9×19 mm Parabellum, .40 S&W, .357 SIG, 10 mm, .45 ACP, 5.7×28 mm and others. Many popular side arms also have 0.22LR conversion slides or adapters for very economical target practice and noise reduction through use of a silencer or suppressor.

Significant drawbacks exist with currently fielded examples of submachine guns and their semi-automatic counterparts. One of the many drawbacks of historical and current submachine guns and their semi-automatic, civilian-legal counterparts is that they are generally not readily converted to other popular calibers. Another drawback is that most historical and current submachine guns and their semi-automatic counterparts are configured with a specific magazine that is tailored only to that specific model of firearm. From a logistics perspective, it would be advantageous if a firearm could be configured so that it would accept a variety of caliber and magazine options and most importantly, that the configuration of a submachine gun or semi-automatic pistol caliber carbine would permit both caliber and magazine interchangeability with a user's side arm.

Therefore, a modular submachine gun, large format pistol, extended range pistol, pistol caliber carbine that overcomes drawbacks, limitations and/or shortcomings associated with historical and presently produced submachine guns, large format pistols, extended range pistols, pistol caliber carbines would be advantageous, desirable and useful. Specifically, a submachine gun and its semi auto counterpart that will deliver interchangeability of caliber-related structural configurations would be advantageous, desirable and useful. Even more specifically, it would also be advantageous, desirable and useful to accommodate various types of ammunition and associated magazine configurations and, interchangeable at the user level, to satisfy interchangeability with the variety of pistol magazines and ammunition calibers used by law enforcement, military and civilian users worldwide.

SUMMARY OF THE DISCLOSURE

Embodiments of the disclosures made herein are directed to magazine and caliber (i.e., ammunition) convertible firearms with simplified production methods. A principal objective of such embodiments is to provide for a submachine gun and its semi auto counterpart that delivers interchangeability of both ammunition and ammunition magazines common to law enforcement, military and civilian pistols. It is also a principal objective of such embodiments to accommodate various types of ammunition and associated magazine configurations and, interchangeable at the user level to satisfy interchangeability with the variety of pistol magazines and ammunition calibers used by law enforcement, military and civilian users worldwide. Still further, it is a principal objective of such embodiments to provide improvements in manufacturing and assembly of weapons while reducing manufacturing costs of same. Thus, embodiments of the disclosures made herein advantageously overcome one or more shortcomings associated with conventional submachine guns, their semi auto counterparts and method of production thereof.

It is a principal objective of the disclosures made herein to provide an improved modular submachine gun, large format pistol, extended range pistol, or pistol caliber carbine that overcomes drawbacks, limitations and/or shortcomings associated with historical and presently produced submachine guns large format pistols, extended range pistols, and pistol caliber carbines. It is a further objective that the present invention provide a means for a modular submachine gun, large format pistol, extended range pistol, pistol caliber carbine to be both caliber and magazine convertible at the user level and without reliance upon special gunsmith skills and for the purposes of streamlined logistics for the military, law enforcement or civilian end user of the disclosures made herein, whereby the caliber and magazine of the disclosures made herein may be interchangeable via conversion kits and methods to match the caliber and magazine of the end user's standard side arm.

To this end, firearms configured in accordance with one or more embodiments of the disclosures made herein preferably permit a user to readily change ammunition type and associated magazine configurations at user discretion. Such a firearm may be optimally practiced as a pistol, rifle, or submachine gun but is not limited to a particular caliber size or configurations. The firearm is preferably of an improved design to both simplify and speed manufacturing and assembly, while simultaneously reducing manufacturing costs normally associated with the firearm industry's usual state-of-the-art (e.g., prior art) methods.

A main body (e.g., sometimes referred to as an upper receiver) of a firearm configured in accordance with one or more embodiments of the disclosures made herein is preferably of a monolithic construction whereby the handguard and breech bolt structure bolt carrying bore can be manufactured from a single piece of material such as, for example, a machined aluminum extrusion or polymer injection-molded component. The monolithic main body can have integral optic, sight and/or accessory mounting methods and structure configured to interface with a trigger group body (i.e., sometimes referred to as a lower receiver). The monolithic main body can contain a charging handle interface such as a slot through which to engage the breech bolt structure, and a means to maintain alignment of the barrel and rotational control of the reciprocating breech bolt structure housed within the main body. Such rotational control of the reciprocating breech bolt structure may be accomplished through provision of additional components such as, for example, one or more pins or a guide plate protruding through the inner wall of the breech bolt structure carrying bore of the main body, or through other means such as an extruded feature disposed within the breech bolt structure carrying bore that engage and interface with another feature such as a longitudinal slot on the breech bolt structure.

In one embodiment of the disclosures made herein, a firearm comprises a main body, a barrel, a breech bolt structure, a buffer assembly, a trigger group assembly, an auto-sear, a magazine adapter and a bolt catch. The main body has a central bore extending between a front-end face at a front-end portion of the main body and a rear end face at a rear-end portion of the main body. The central bore defines a centerline longitudinal axis of the main body. The barrel is attached to the main body at the front-end portion thereof. The barrel includes a chamber portion at a proximate end portion thereof. The chamber portion is positioned within the central bore adjacent to an ammunition supply port of the main body. The breech bolt structure is slidably disposed with the central bore of the main body. A front-end portion of the breech bolt structure and the chamber portion of the barrel are jointly configured for matingly engaging each other within the central bore. The buffer assembly is attached to the main body at the rear-end portion thereof. The buffer assembly includes a buffer slidably disposed within the central bore of the main body. The buffer forcibly biases the breech bolt structure into contact with the chamber portion of the barrel. Alternatively, the buffer assembly may be integral to the breech bolt structure and in at least one embodiment of either a separate buffer or buffer that is integral to the breech bolt, may contain an anti-bolt bounce mechanism such as cascading inertial weights, atomized material or hydraulic or hydropnuematic buffering means, The trigger group assembly comprises a trigger group body attached to the main body and a trigger group mounted thereon. The trigger group body includes a magazine well structure defining a magazine well space overlying at least a portion of the ammunition supply port of the main body. The magazine well structure is adapted for having an ammunition magazine located within the magazine well space thereof for enabling ammunition carried by the ammunition magazine to be operably supplied from the ammunition magazine through the ammunition supply port of the main body into the chamber portion of the barrel. The auto-sear is mounted entirely on the main body. A first portion of the auto-sear engages a mating structure of the trigger group for enabling each instance of automatic firing function. The buffer engages a second portion of the auto-sear for initiating each instance of said automatic firing function after the first portion of the auto-sear engages the mating structure of the trigger group. The magazine adapter has an exterior surface structure engaged with a mating interior surface structure of the magazine well space and having an interior surface structure engageable with an exterior surface structure of the ammunition magazine for enabling the ammunition magazine to be retained and positioned within the magazine well space to provide for said operable supply of ammunition. The bolt catch is movably attached to at least one of the main body and the stripper group body. The bolt catch has opposing user interface portions for enabling ambidextrous operation by a user. Such ambidextrous operation includes manually moving the bolt catch from a deployed position to a retracted position for enabling the breech bolt structure to travelling from a displaced position to a battery position.

In one or more embodiments, the main body can be a monolithic main body.

In one or more embodiments, the proximal end and the distal end of the main body are connected by a bore passing longitudinally through the monolithic main receiver body. Such bore passing longitudinally through the main body can be designed to accommodate a barrel, breech bolt structure and, in some cases, a buffer assembly (e.g., main action spring assembly). Disposed between the main body's proximal end and distal end can be a trigger group body interface surface through which the fire control components (i.e., a trigger group) such as the hammer or sear can engage with a firing pin, striker or breech bolt that is disposed within the main receiver body.

In one or more embodiments, magazine adapters can properly accommodate and position magazines of different configurations in a magazine well space of the firearm for providing proper function (i.e., ammunition supply, bolt catch function, cartridge stripping function, etc.).

In one or more embodiments, kits can be provided in the form of components required for converting the firearm from one type of ammunition to a different type of ammunition.

In one or more embodiments, the main body can have a common bore through which to mount the breech bolt structure and barrel, a barrel retention means such as threading on a distal end and a butt stock receiver extension tube retention means such as threading on a proximate end.

In one or more embodiments, the main body can have a common bore through which to mount the breech bolt and barrel, a barrel retention means such as threading on a proximal end and a butt stock receiver extension tube integral to the monolithic main receiver body on a distal end.

In one or more embodiments of the disclosures made herein, a pivoting safety sear (auto sear) can be completely mounted upon at least one of the main body and a trigger (fire control) housing.

In one or more embodiments, a pivoting safety sear (auto sear) can be activated by the breech bolt, the buffer body, or other means interfacing between a reciprocating mass and the pivoting auto-sear.

In one or more embodiments, a trigger group body is detachably mounted to the main body.

In one or more embodiments, a magazine well structure can be integral to the trigger group body.

In one or more embodiments, the magazine well structure can be selectively and proportionally sized and angularly accommodating ammunition magazines of different shapes, sizes and calibers.

In one or more embodiments, the trigger, hammer and fire control selector can be completely mounted upon the trigger group body or can be housed within a subassembly that is then mounted completely upon the trigger group body.

In one or more embodiments, the trigger, hammer and safety selector can be completely mounted upon the main body or can be housed within a subassembly that is then mounted completely upon the main body.

In one or more embodiments, the magazine retention latch can be optimized for interface with a specific magazine type or can be selectively configurable for interface with multiple magazine types.

In one or more embodiments, the breech bolt can provide a housing for a firing pin, spring, extractor, and firing pin retaining pin.

In one or more embodiments, the firing pin can be mounted to an inertial striker.

In one or more embodiments, the ejector can be mounted entirely upon the main body or mounted entirely upon the trigger group body or mounted entirely upon magazine adapters.

In one or more embodiments, a last-round fired "bolt catch" structure can automatically lock the breech bolt structure in the rearward position after firing the last round in the ammunition magazine.

In one or more embodiments, the last-round fired "bolt catch" structure can be mounted on the trigger group body or takedown pin, monolithic receiver body or magazine well adapter.

In one or more embodiments, a distal end portion of the anti-rotation structure is engageable by the buffer for limiting forward travel of the buffer when the barrel is detached from the main body.

In one or more embodiments, at least one edge portion of the anti-rotation structure selectively includes a contoured portion therein within which at least a portion of the hammer of the trigger group resides when it is in a cartridge firing position or the anti-rotation structure does not include a contoured hammer clearance portion therein.

In one or more embodiments, the firearm further comprises a magazine release assembly mounted on the magazine well structure of the trigger group body.

In one or more embodiments, the magazine release assembly is selectively configurable for being compatible with the ammunition magazine engageable by the magazine adapter.

In one or more embodiments, the magazine release assembly includes a magazine release arm having a user interface portion adjacent a proximate end portion thereof and a magazine engaging element adjacent a distal end portion thereof and the magazine engaging element is selectively detachable from and engageable with the distal end portion of the magazine release arm.

These and other objects, embodiments, advantages and/or distinctions of the disclosures made herein will become readily apparent upon further review of the following specification, associated drawings and appended claims.

DETAILED DESCRIPTION

Figure 1:
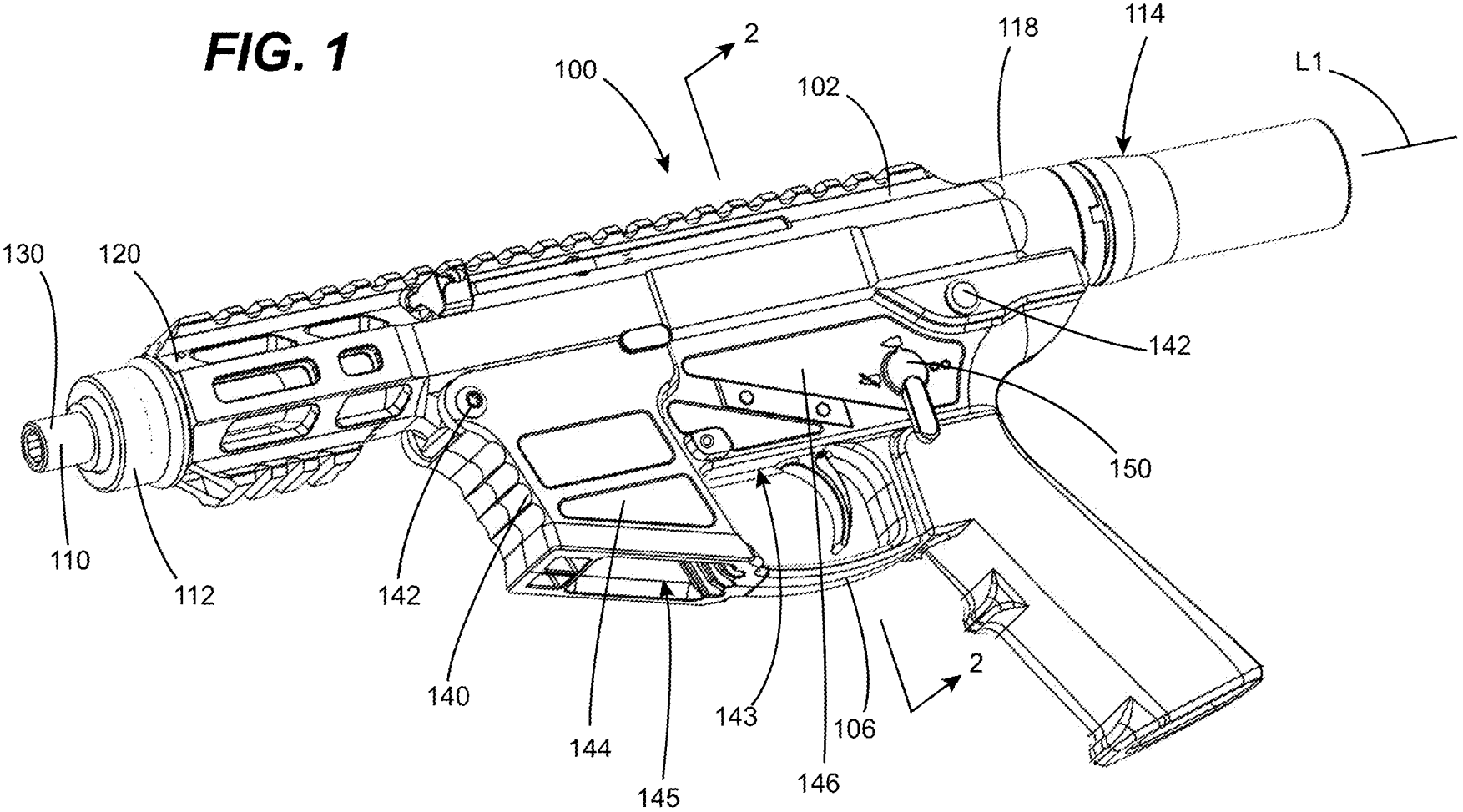
FIG. 1 is a perspective view showing a firearm configured in accordance with an embodiment of the disclosures made herein.

Disclosed herein are firearms beneficially configured for enabling a magazine configuration thereof to be convertible, a caliber configuration thereof to be convertible, or both. Accordingly, firearms configured in accordance with one or more embodiments of the disclosures made herein advantageously have a structural arrangement that enables ammunition calibers and associated magazine types to be readily altered at a user's discretion, and may be practiced as a pistol, rifle, submachine gun or the like and is not limited to a particular caliber size or configurations. Such convertibility enables a single firearm to be configurable to accept different types of ammunition and configurations of magazines. Beneficially, such firearm provides for magazine configuration thereof and/or caliber configuration thereof implemented in relatively simplified production methods (e.g., simplified and more rapid manufacturing and assembly, while simultaneously reducing manufacturing costs normally associated with the firearm industry's usual state-of-the-art fabrication methods). Such firearms can also be configured with improved, novel structural and functional implementations related to trigger group configuration, breech bolt structure guide/alignment configuration, barrel guide/alignment configuration, auto-sear trip configuration and other firearm operational elements.

Referring to FIGS. 1-4, a firearm 100 configured in accordance with one or more embodiments of the disclosures made herein is shown. The firearm 100 is configured with numerous structural implements that provide associated advantageous functionality. One such structural implement is a magazine well structure that is convertible for receiving different configurations of magazines and thus respective types of ammunition. Another such structural implement is a barrel mounting structure that is configured to enable mounting of different configurations of barrels and thus enabling firing of such different types of ammunition. Still another such structural implement is an auto-sear mounting structure that is mounted entirely on a main body of the firearm (e.g., upper receiver, breech bolt structure carrying body, etc.) and that enables buffer-tripped actuation thereof. Yet another such structural implement is a breech bolt structure guide arrangement that simplifies fabrication of one or more breech bolt structure components while still reliably providing required breech bolt structure guidance functionality.

The firearm 100 has a main body 102, a breech bolt structure 104, a trigger group assembly 106, an auto-sear 108, a barrel 110, a barrel fastener 112 and a buffer assembly 114. The main body 102 has a central bore 116 defining a longitudinal axis L1 thereof. The central axis 116 extends along a length of the main body 102. The central bore 116 is accessible at a rear end portion 118 (i.e., a buffer assembly mounting portion) of the main body 102, at a front-end portion 120 (i.e., a barrel mounting portion), at a bottom access opening 122 and an ejection port 124. In one or more embodiments, the main body 102 can be the upper receiver of a firearm comprising upper and lower receivers.

In one or more embodiments, as shown in FIGS. 1-4, the main body 102 can have a monolithic construction. To this end, the main body 102 can be manufactured from a single piece of material such as, for example, a CNC machined piece of aluminum or other metal alloy billet or extrusion, an injection molded polymeric component, a 3-D printed polymeric component, or the like. Interior and exterior features (e.g., passages, openings, exterior surface details, and the like) of the main body 102 can be integrally formed in such a monolithically-constructed main body. Specific examples of such interior and exterior features include a central bore extending between opposing end faces of the main body 102, passages extending from the central bore 116 to one or more exterior surfaces (e.g., bottom face passage, charging handle passage, ejection port, etc.), handguard features on one or more exterior surfaces, accessory and sight mounting features on one or more exterior surfaces, and the like. In one or more embodiments, such a monolithic main body can have a common bore through which to mount a breech bolt structure and barrel, a barrel retention means such as threading on a distal end of the main body and a butt stock receiver extension tube retention means such as threading on a proximate end of the main body.

The breech bolt structure 104 is slidably disposed within the central bore 116 of the main body 102. Such breech bolt structure 104 provides the functionality of closing the chamber of the barrel 110 and facilitating firing of a round of ammunition in the chamber. Structurally, the breech bolt structure 104 can have any number of specific configurations—i.e., carrier with separate breech bolt (e.g., locking breech bolt or non-locking breech bolt), carrier with unitary breech bolt (e.g., combined bolt and carrier) and the like. It is disclosed herein that the breech bolt structures in accordance with embodiments of the disclosures made herein can be implemented in both an open bolt firearm configuration and a closed bolt firearm configuration.

Figure 2:
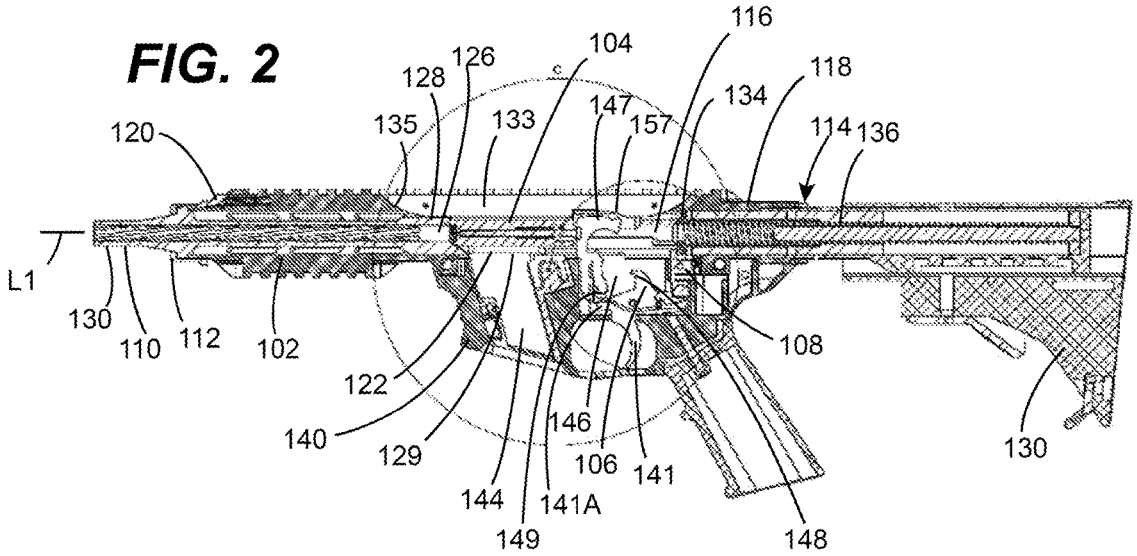
FIG. 2 is a cross-sectional taken along the line 2-2 in FIG. 1.
Figure 3:
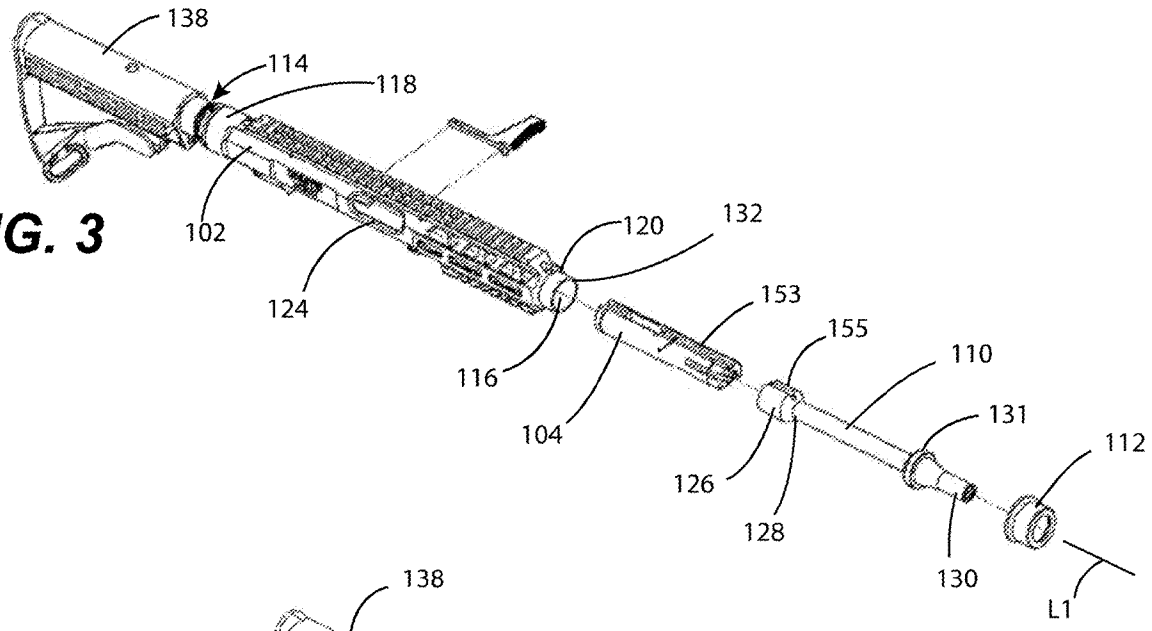
FIG. 3 is an exploded view of a first portion of the firearm of FIG. 1.

As best shown in FIGS. 1-3, the barrel 110 is mounted on the main body 102 at its front-end portion 120. A chamber portion 126 at a proximate end portion 128 of the barrel 110 is positioned within the central bore 116 of the main body 102 ahead of a chamber engaging portion of the breech bolt structure 104. A chamber engaging portion (i.e., front-end portion) of the breech bolt structure 104 and the chamber portion of the barrel 110 are jointly configured for matingly engaging each other within the central bore 116 of the main body 102. A distal end portion 130 of the barrel 110 extends forward of the main body 102. The barrel 110 is secured in fixed relationship to the main body 102 by a flange 131 of the barrel 110 that abuts a forward face 132 of the main body 102 and by the barrel fastener 112 (e.g., a securement element) being releasably secured (e.g., threadedly) to the main body 102 and retaining the flange 131 in its abutted engagement with the forward face 132 of the main body 102 (or other structure of the main body 102). The main body 102, the barrel 110 and the barrel fastener 112 are jointly configured for enabling the barrel 110 to be manually removed and reinstalled/replaced in a simple manner.

When the main body 102 is of a monolithic construction, the main body 102 has a suitable forward length (i.e., a length ahead of an ammunition feed port) to accommodate integral structures on one or more exterior surfaces such as handguard features, accessory and sight mounting features and/or the like. Accordingly, a distance between the chamber portion 126 and the flange 131 of the barrel 110 can be defined at least partially by the forward length of the main body 102. In such cases, the barrel 110 can have a unitary construction that includes the chamber portion 126 and the flange 131 with a suitable distance of barrel material extending therebetween, as shown in FIG. 3.

Advantages of a monolithic construction are several, including precise timing and location of external features to the bore axis datum and precise timing and location of external features to a perpendicular or other angled datum plane to the bore axis datum and its parallel planes. Because all core features of the main are molded, extruded, forged or machined into or onto a common monolithic piece of material, this approach reduces inaccuracies of a finished product due to tolerance stack-up between individual components being subsequently attached through other fastening means. Additionally, it reduces individual manufacturing costs of each component such as an optic interface rail that would have to be produced, inspected and finish coated separately, and reduces labor costs associated with manually adding "bolt-on" features such as optic interfaces that can then become loose from firing or rough handling. Dissimilar metal corrosion risk is reduced (e.g. steel fasteners engaging aluminum body threads as an example) and the resulting monolithic receiver body is more rigid, robust and accurate when compared to a product that is the sum of many parts and features being fastened into place. An advantage of using detachable receiver extension tubes provides for manufacturer or user flexibility to change or customize receiver extension tubes or accessories from the distal end of the monolithic receiver body at a future date.

Figure 4:
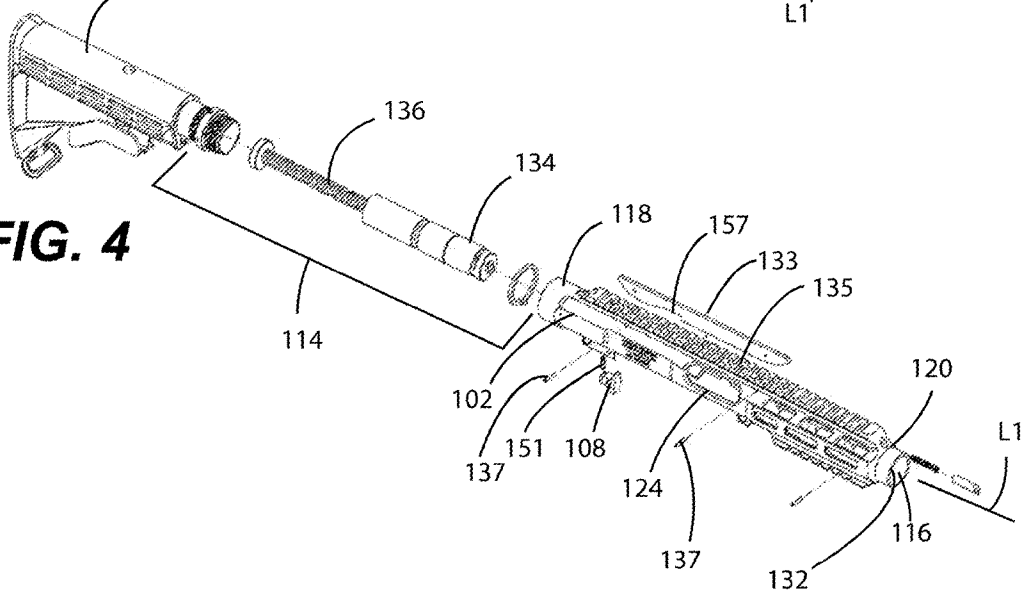
FIG. 4 is an exploded view of a second portion of the firearm of FIG. 1.

In one or more embodiments of the disclosures made herein, as shown in FIGS. 2-5, the firearm 100 utilizes an anti-rotation structure 133 mounted on the main body 102 to define and maintain a rotational position of the breech bolt structure 104 and the barrel 110 relative to the central bore 116 of the main body 102 in a simple to manufacture and assemble manner. As best shown in FIGS. 2 and 4, the anti-rotation structure 133 is positioned within an elongated passage 135 (e.g., machined into a top or other surface of the main body 102) that extends from an exterior surface of the main body 102 to its central bore 116. The anti-rotation structure 133 can be secured in place by a securing means such a roll-pin or plurality of roll or push pins 137 (or other type of securement structure) that each engage respective associated securement features (e.g., pin passages) of the main body 102 and the anti-rotation structure 133. As best shown in FIGS. 2 and 3, the anti-rotation structure 133 extends into the central bore 116 of the main body 102 by a sufficient length to engage a mating groove 153 extending at least partially along a length of the breech bolt structure 104 at its exterior surface and to engage a mating groove 155 extending at least partially along a length of the chamber portion 126 of the barrel 110.

Figure 5:
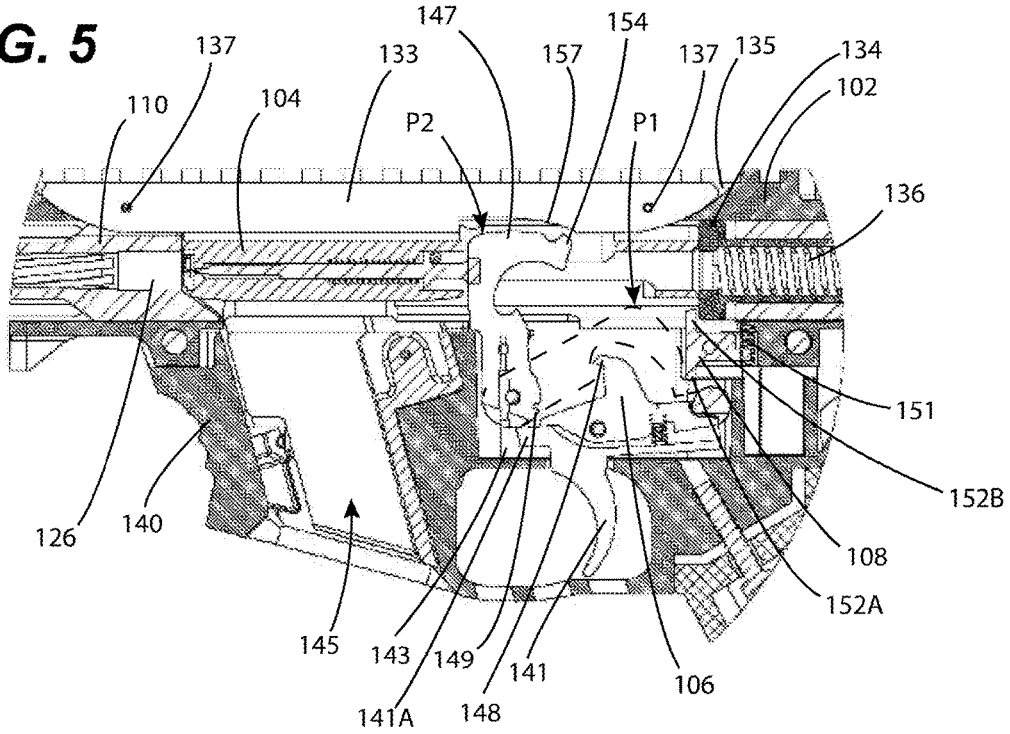
FIG. 5 is an enlarged view of a portion of the cross-sectional view of FIG. 2.

In one or more preferred embodiments, the anti-rotation structure 133 can have a continuous edge portion (e.g., an elongated plate structure) of a sufficient length to engage both the mating groove 153 of the breech bolt structure 104 and the mating groove 155 of the chamber portion 126 of the barrel 110. In one or more other embodiments, the anti-rotation structure 133 can have a segmented edge portion where a first one of such segments engages at least a portion of the mating groove 153 of the breech bolt structure 104 and a second one of such segments engages at least a portion of the mating groove 155 of the chamber portion 126 of the barrel 110. In one or more embodiments, as best shown in FIGS. 2, 4 and 5, the anti-rotation structure 133 can have a contoured portion 157 within which a hammer 147 of the trigger group assembly 106 resides when it is in a cartridge firing position (i.e., a firing pin engaging position). In one or more embodiments, as best shown in FIG. 5, the anti-rotation structure 133 can have a shape and size that inhibits unrestricted forward travel of the buffer 134, thereby limiting forward travel of the buffer 134 when the barrel 110 and breech bolt structure 104 are removed from the central bore 116 of the main body 102 (e.g., during field dressing of a firearm). In one or more embodiments, the anti-rotation structure can engage a mating groove in a firing pin striker to maintain the striker's rotational relationship within the central bore 116 of the main body 102.

The buffer assembly 114 is mounted on the main body 102 at its rear end portion 118. A buffer 134 of the buffer assembly 114 is slidably disposed within the central bore 116 of the main body 102 adjacent to its rear end portion 118. A main action spring 136 of the buffer assembly 114 forcibly biases the breech bolt structure 104 into engagement with the chamber portion 126. In one or more embodiments, a stock 138 can be fixedly or retractably (e.g., slidably) mounted on the buffer assembly 114.

As best depicted in FIGS. 1 and 2, the trigger group assembly 106 includes a trigger group body 140 mounted on a mating bottom portion of the main body 102. In one or more preferred embodiments, trigger group body 140 is attached to the main body 102 through a single or plurality of push pins 142 (or other type of securement structure) that each disengagably engage respective associated securement features (e.g., pin passages) of the main body 102 and the trigger group body 140. Such disengagable engagement of the push pins 142 from the respective associated securement features of the main body 102 and the trigger group body 140 provide for the trigger group body 140 to be selectively detached from the main body 102. In one or more embodiments, the trigger 141, a hammer 147 and a fire control selector 150 can be completely mounted upon the trigger group body 140 or can be mounted on a subassembly that is mounted at least partially on the trigger group body 140.

The trigger group body 140 includes a magazine well structure 144 having therein a magazine well space 145 and a trigger group structure 146 having therein a trigger group space 143. The magazine well structure 144 and the trigger group structure 146 include a respective passage in the trigger group body 140 through which corresponding interior portions of the main body 102 are accessible. Such corresponding interior portions of the main body 102 are accessible through the bottom access opening 122 in a bottom wall 129 of the main body 102 (e.g., an ammunition feed port and/or breech bolt structure access port). The central bore 116 of the main body 102 within which the breech bolt structure 104 slidingly resides is accessible through the magazine well space 145 for enabling ammunition to be fed from a magazine within the magazine well space 145 into a corresponding portion of the central bore 116 and is accessible through the trigger group structure 146 for enabling the hammer 147 of the trigger group assembly 106 within the trigger group structure 146 to interact with a firing pin mounted on the breech bolt structure 104 and with the auto-sear 108.

As depicted in FIGS. 4 and 5, in one or more preferred embodiments, the auto-sear 108 is pivotably mounted entirely on the main body 102. A resilient member 151 (e.g., a spring) biases the auto-sear 108 to an at-rest position (i.e., a position ready for engagement by a portion of a breech bolt or buffer or other engaging means. As is well known in the art, a disconnector 148 (callout not shown. 106 is pointing at the disconnector), primary sear 149 and the fire control selector 150 of the trigger group assembly 106 as well as the auto-sear 108 of the main body 102 are jointly configured to allow for selection and implementation of semi-automatic firing and fully-automatic firing, as best shown in FIG. 5.

As to benefits of the auto-sear 108 being mounted on the main body 102, current US laws and regulations define what constitutes a "firearm" and a "machine gun" and a "machine gun conversion device" as defined in Acts of Congress such as the 1934 National Firearms Act, the 1968 Gun Control Act, the 1986 Firearm Owner's Protection Act and are interpreted and enforced by the Bureau of Alcohol Tobacco, Firearms and Explosives. In view of such laws and regulations, it is advantageous to mount the auto-sear 108 entirely on the "firearm receiver" itself (e.g., on the main body 102), because the monolithic receiver body of the disclosures made herein meet the legal definition of a "receiver" for a firearm and bears the requisite serial number of the "machine gun" firearm. This eliminates the possibility of a separate trigger housing or other component or assembly of parts being accidentally or deliberately construed as a "machine gun" or "machine gun conversion device" under current US laws.

It is also disclosed herein that, in one or more embodiments, the auto-sear 108 can be pivotably mounted on the trigger group body 140 or a component or subassembly thereof. As to benefits of the auto-sear 108 being mounted on the trigger group body 140, it may be advantageous for reduced manufacturing costs or other reasons to mount the safety sear (auto sear) for a machine gun of the disclosures made herein completely or entirely to the trigger housing or fire control group itself. For example, such a mounting arrangement may be beneficial for the purposes of manufacturing or sales in other parts of the world where Acts of Congress and jurisdiction of the Bureau of Alcohol Tobacco, Firearms and Explosives do not apply. An end-user scenario where this may also be important is when an issuing agency may want to control the issuance of a semi-auto firearm for daily patrol, but then readily convert the firearm into a machine gun during times of heightened alert such as wartime or terrorist threat or attack.

Referring to FIG. 5, when fully-automatic firing is selected, the disconnector 148 and the auto-sear 108 both move to an active orientation (e.g., rotated into such active configuration by movement of the fire control selector 150), depression of the trigger 141 releases the hammer 147 from the trigger's primary sear 141A via the hammer's primary sear engaging interface 149 thereby allowing the hammer 147 to forcibly move from its ready-to-fire configuration P1 (i.e., hammer's primary sear engaging surface 149 engaged with trigger 141) to its firing pin engaging position P2 to fire a first round of ammunition during such automatic firing. Such firing of the round of ammunition causes rearward travel of the breech bolt structure 104 and buffer 134 via direct blowback, delayed blowback or gas-energization from the fired round of ammunition. During such rearward travel, the breech bolt structure 104 engages and rotates the hammer 147 back into its ready-to-fire configuration P1. But, with the trigger still depressed and the auto-sear 108 in its active orientation, such rotation of the hammer 147 causes a first engagement portion 152A (e.g., lower leg) of the auto-sear 108 to become engaged with a mating auto-sear engaging portion 154 of the hammer 147, as best shown in FIG. 5. The resilient member 151 (e.g., a spring) biases the auto-sear 108 to the at-rest position—i.e., a position ready for engagement by the mating auto-sear engaging portion 154 of the hammer 147.

Upon arresting of such rearward movement of the breech bolt structure 104 and buffer 134 by the main action spring 136, rearward travel imparted energy of the main action spring 136 causes forward movement of the breech bolt structure 104 and buffer 134. In synchronous action with the breech bolt structure 104 acquiring its chamber closing (i.e., battery) position relative to the chamber portion 126 of the barrel 110, such forward movement of the breech bolt structure 104 and buffer 134 causes a surface of the buffer 134 (or, alternatively, portion of the breech bolt structure 104 or other mass reciprocating within the central bore 116) to engage a second engagement portion 152B of the auto-sear 108, thereby tripping the auto-sear 108 and causing its rotation to release the hammer 147 and the hammer 147 to forcibly move from its auto-fire ready-to-fire configuration P1 (i.e., first engagement portion 152A of the auto-sear 108 engaged with a mating auto-sear engaging portion 154 of the hammer 147) to its firing pin engaging position P2 to fire a second round of ammunition during such automatic firing. So long as the trigger 141 remains depressed and additional rounds of ammunition remain available, each successive round of ammunition fired causes rotation of the hammer 147 back into its ready-to-fire configuration and then release of the hammer by engagement of the surface of the buffer 134 engaging the second engagement portion 152B of the auto-sear 108 thereby causing rotation of the auto-sear 108 to release the hammer 147 and the hammer 147 to forcibly move from its auto-fire ready-to-fire configuration P1 to its firing pin engaging position P2 to fire the next round of ammunition. In another embodiment, the auto sear 108 has no interface with the selector 150 and is always in an active position for automatic fire. In this case the disconnector is the only part that is rotated to disengage from interaction with the hammer by the selector 150. In such case, the disconnector is preventing automatic fire during semi-automatic selection and the "active" auto sear portion 152A engages the hammer portion 154 and is tripped at the second leg of the auto-sear by the carrier or buffer during each cycle of operation.

Figure 6:
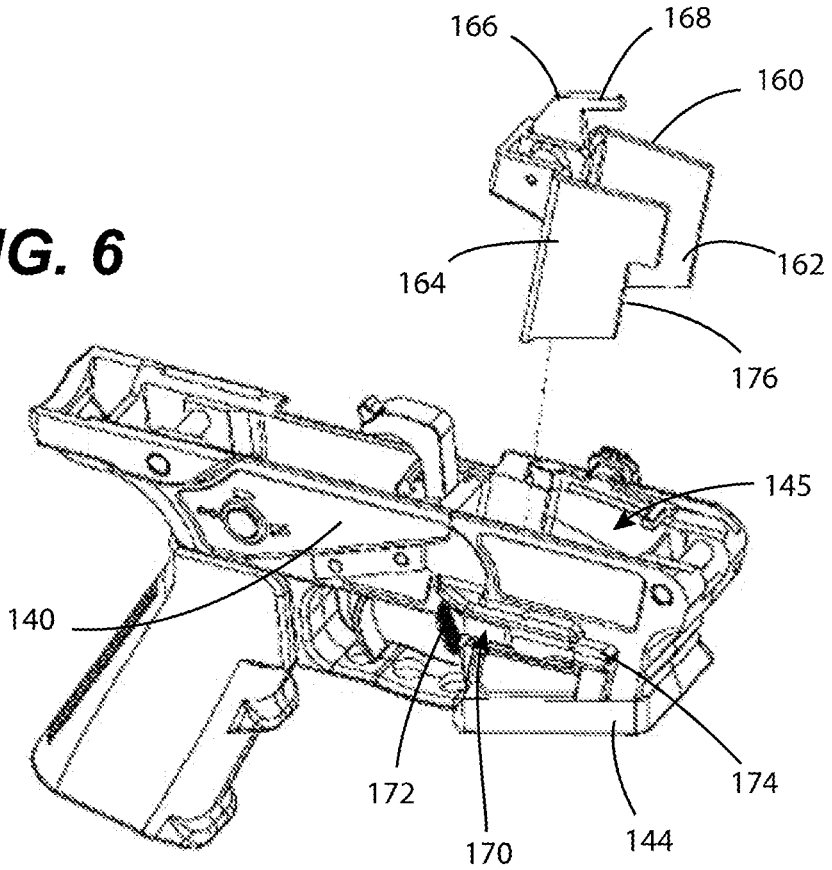
FIG. 6 is a perspective view of the trigger group assembly of the firearm shown in FIG. 1, with a magazine adapter shown disengaged from a trigger group body of the trigger group assembly.
Figure 7:
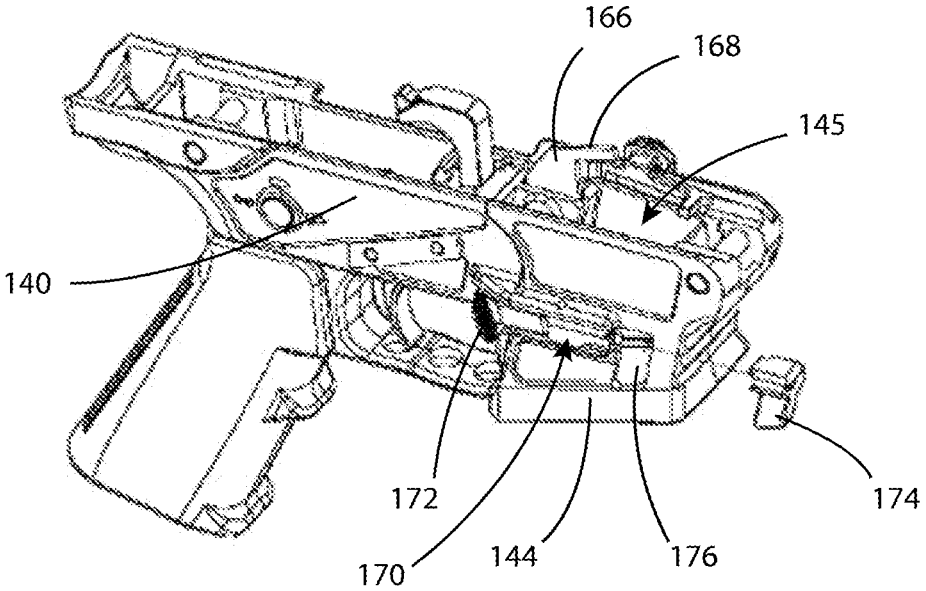
FIG. 7 is a perspective view of the trigger group body of the firearm shown in FIG. 1, with a magazine adapter shown engaged with the trigger group body of the trigger group assembly.

Turning now to FIGS. 6 and 7, the magazine well structure 144 of the trigger group body 140 utilized in the firearm 100 disclosed herein (i.e., a firearm configured in accordance with one or more embodiments of the disclosures made herein) advantageously enables ammunition type and associated magazine configuration to be readily altered (e.g., caliber, cartridge size, various manufacturer's models, etc.) at a user's discretion. Such ability to convert the firearm 100 from one type of ammunition that requires a first magazine configuration to a different type of ammunition that requires a different magazine configuration that is not compatible from a firearm engaging consideration as the first magazine configuration.

In support of such ability to alter ammunition type and associated magazine configuration, the firearm 100 also provides for barrels and/or breech bolt structures (or components thereof such as a breech bolt carrier) to be readily altered (i.e., swapped out). In the case of the barrels, a chamber portion and other features of each barrel varies based upon a particular type of ammunition or magazine being used. In the case of the breech bolt structures, a barrel engaging portion of each breech bolt structure varies based upon a particular type of ammunition being used. To provide for such convertible utilization of such barrels in a given main body, attributes of the barrels such as, for example, the outside diameter and overall construction of the breech bolt structure (e.g., outside diameter of the chamber portion and configuration of the main body engaging flange portion) are preferably the same. To provide for such convertible utilization of such breech bolt structures in a given main body, attributes of the breech bolt structures (e.g., breech bolt carrier outside diameter and non-barrel engaging portions thereof) are preferably the same.

Still referring to FIGS. 6 and 7, a magazine adapter 160 is mountable within the magazine well space 145 of the trigger group body 140. In preferred embodiments, the magazine adapter 160 is seated into the magazine well space 145 from a top portion of the trigger group body 140. The magazine adapter 160 and the trigger group body 140 are preferably jointly configured such that the magazine adapter 160 is captured between the trigger group body 140 and the main body 102 when the trigger group body 140 is mounted on the main body 102 whereby the magazine adapter 160 is retained within the magazine well space 145.

The magazine adapter 160 preferably includes an exterior portion 164 structurally configured for interfacing with and engaging one or more interior structural features of the magazine well structure 144 and can include an interior portion 162 structurally configured for interfacing with and engaging one or more exterior structural features of a particular magazine. Such interfacing and engaging enables a plurality of magazines to be disengagably engaged within the magazine well space 145 of the magazine well structure 144 of the firearm 100. In this manner, the magazine adapter 160 is configured for jointly engaging both an interior structural configuration of the magazine well structure 144 and an exterior structural configuration of a particular magazine. Thus, each one of a plurality of magazine adapters can be configured for engaging the interior structural configuration of the magazine well structure 144 and the exterior structural configuration of a respective magazine—i.e., a magazine adapted for receiving a particular type of ammunition and thereby provide for proper accommodation and positioning related of a respective magazine for proper function. In this regard, each of the magazine adapters is selectively and proportionally sized and angularly/positionally accommodating ammunition magazines of different shapes, sizes and calibers.

Where a plurality of ammunition types each require a respective different configuration of magazine, a set of magazine adapters provide a means for enabling each one of the ammunition types to be supplied to a firearm in accordance with one or more embodiment of the disclosures (e.g., the firearm 100). In one or more embodiments, to convert the firearm to be operable with a plurality of different ammunitions will require a corresponding set of magazine adapters, a corresponding set of barrels, and a corresponding set of breech bolt structures (or chamber engaging portion thereof). Such magazine adapters can be formed from known materials using known methods of manufacture.

In one or more embodiments, kits can be provided in the form of at least a breech bolt structure (or component(s) thereof) and a barrel for accommodating various calibers of ammunition, in the form of at least a magazine adapter and a breech bolt structure (or component(s) thereof, in the form of at least a plurality of magazine adapters each configured for a respective type of ammunition, in the form of at least a plurality of magazine adapters each configured for a respective type of ammunition, a plurality of magazine release arm structures and a plurality of barrels each having a chamber portion configured for a respective type of ammunition, or a combination of such forms of kits. The combination of such forms of kits can be configured to include any combination of barrel(s), magazine adapter(s), breech bolt structure(s) (or component(s) thereof), magazine release arm structure(s) (or component(s) thereof), and the like.

Alternatively to a plurality of magazine adapters, in one or more other embodiments, providing for ammunition magazine convertibility of a firearm can be provided by a plurality of trigger group bodies that each have a magazine well space configured to engage the exterior structural configuration of a respective magazine that is adapted for receiving a particular type of ammunition and thereby provide for proper accommodation and positioning related of a respective magazines for proper function. In this respect, each of the trigger group bodies is selectively and proportionally sized and angularly/positionally accommodating ammunition magazines of different shapes, sizes and calibers.

As shown in FIGS. 6 and 7, the magazine adapter 160 can include a cartridge ejector 166. The cartridge ejector 166 may be resiliently biased (e.g., spring-biased) into an at-rest position in which a cartridge stripping portion 168 of the cartridge ejector 166 extends upward and away from a lower portion of the magazine adapter 160. When the breech bolt structure 104 is subject to rearward travel resulting from firing of a round of ammunition of the breech bolt structure 104, the cartridge stripping portion 168 of the cartridge ejector 166 is urged against a lower surface of the breech bolt structure 104 such as by spring biasing. Upon sufficient rearward travel of the breech bolt structure 104, the cartridge stripping portion 168 of the cartridge ejector 166 engages a base portion of a casing of a spent round cartridge on the breech bolt structure 104, thereby stripping the casing and causing it to be ejected from the main body 102 through the ejection port 124 of the main body 102. In one or more other embodiments, the ejector 166 can be mounted entirely upon the main body 102 or mounted entirely upon the trigger group body 140. In another embodiment, an ejector can be mounted entirely within or pass through a passage in the breech bolt 104.

Still referring to FIGS. 6 and 7, the trigger group body 140 has a magazine release assembly 170 mounted on the magazine well structure 144 or trigger group body 140 or trigger group structure 146. Magazine release assemblies are well known in the art. Advantageously, the magazine release assembly 170 (i.e., a magazine release assembly in accordance with one or more embodiments of the disclosures made herein) is adapted to accommodate use of a plurality of different magazine types with the trigger group body 140. To this end, the magazine release assembly 170 includes a magazine release arm 172 having a user interface portion adjacent a proximate end portion thereof and includes a magazine engaging element 174 adjacent a distal end portion thereof. The magazine release arm 172 and the magazine engaging element 174 jointly define a magazine release arm structure. The magazine release arm 172 is pivotably attached to the trigger group body 140, or alternatively the magazine release arm 172 is pivotably attached to an intermediate structure that is attached to or slidably passes through the trigger group body 140 whereby depression of the proximate end portion causes a corresponding displacement of the distal end portion and resulting retraction of the magazine engaging element 174 at least partially from within a magazine accessing passage 176 (FIG. 7) of the trigger group body 140. Such retraction of the magazine engaging element 174 from within the magazine accessing passage 176 results in retraction of the magazine engaging element 174 from a mating engagement structure of a compatible magazine (i.e., a magazine having an engagement structure engageable by the magazine engaging element 174). As shown in FIG. 6, the magazine adapter 160 can include an access feature 176 (e.g., contoured edge portion or closed window passage) that provides material clearance for enabling the magazine engaging element 174 to engage the mating engagement structure of the compatible magazine.

As best shown in FIG. 7, the magazine engaging element 174 has a size and shape enabling its engagement with a mating engagement structure of a magazine that is compatible with the magazine engaging element 174. Such engagement is provided through the magazine accessing passage 176 of the trigger group body 140. The magazine engaging element 174 is selectively detachable from the magazine release arm 172. For example, the magazine release arm 172 can have a dovetail structure that is engageable by a mating dovetail structure of the magazine engaging element 174. The magazine engaging element 174 can be engaged with the magazine release arm 172 via the mating dovetail structures. A mating securement arrangement of the magazine release arm 172 and the magazine engaging element 174 (e.g., a detent and recess arrangement) provides for securement of the magazine engaging element 174 in an intended position on the magazine release arm 172. Each configuration magazine can have an associated compatible magazine engaging element 174 that can be engaged with the magazine release arm 172 when a corresponding magazine and magazine adapter are in use.

In one or more other embodiments, a magazine release assembly includes a magazine release arm structure having a magazine release arm and a magazine engaging element that are of a one-piece construction. As is well known in the art, such a magazine release assembly (e.g., magazine release arm structure and associated mounting element, resilient biasing elements, etc.) can be manually removed and installed by a user without special tools and generally without any tools. The magazine release arm of such a one-piece magazine release arm structure is universal to the firearm and the magazine engaging element is specific to a respective magazine. To accommodate ammunition convertibility provided for by usage of different magazines in a firearm as disclosed herein, a plurality of one-piece magazine release arm structures can be provided, where each of the one-piece magazine release arm structures has a magazine engaging element that is structurally configured (i.e., magazine engaging feature(s) thereof) are unique to at least one respective magazine.

Figure 8:
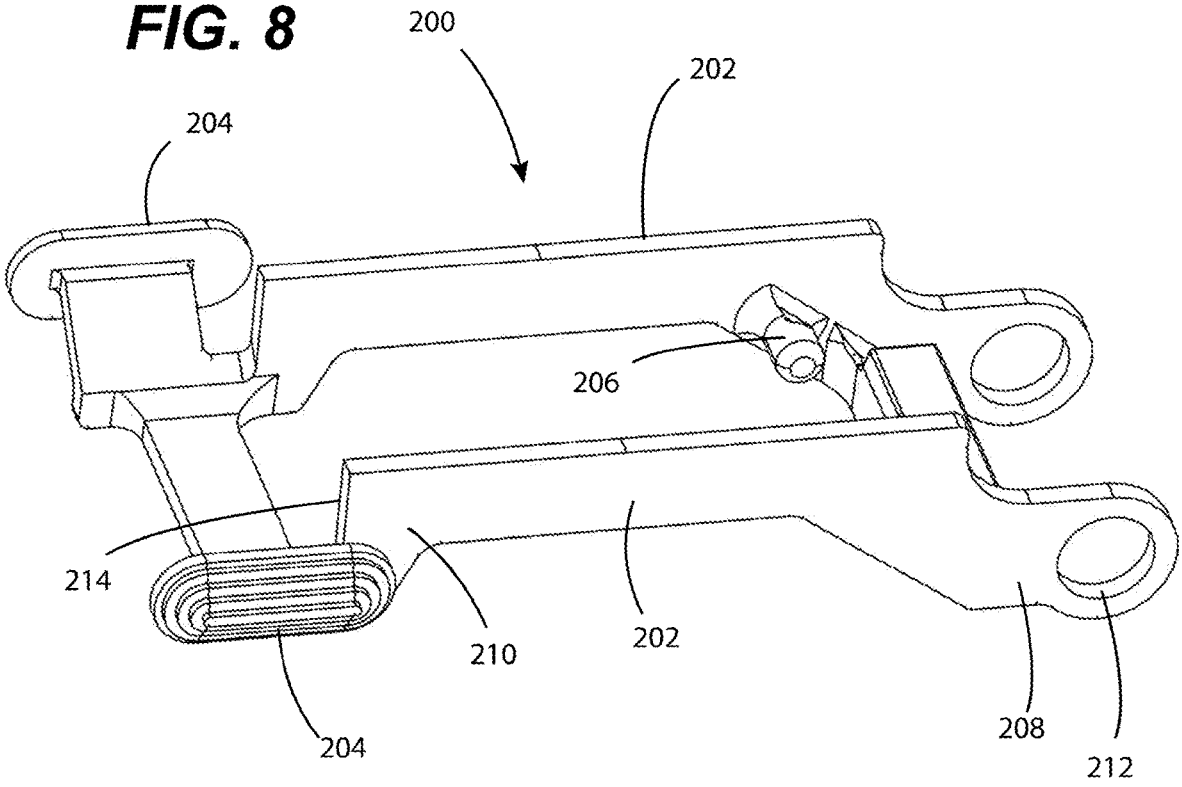
FIG. 8 is an ambidextrous bolt catch structure configured in accordance with one or more embodiments of the disclosures made herein.

Referring to FIG. 8, in one or more embodiments, a bolt catch 200 offering ambidextrous user interface operability is provided. The bolt catch 200 includes opposing legs 202, opposing user interface portions 204, and a magazine follower engaging structure 206. Each of the legs 202 each have a proximate end portion 208 and a distal end portion 210. Each of the legs or at least one of the legs 202 has a mounting structure 212 (e.g., a hole) at the proximate end portion 208 thereof and a bolt face engaging surface 214 at the distal end portion 210 thereof. Each of the user interface portions 204 is adjacent to the distal end portion thereof of a respective one of the legs 202. Each of the user interface portions 204 is attached to at least one of the legs 202 and is located outboard of the respective one of the legs 202. The magazine follower engaging structure 206 is attached to a respective one of the legs 202 and extends inboard of the respective one of the legs 202. In one or more embodiments, the bolt catch 200 can be mounted via the trigger group body 140, via one of the push pins 142 (or other type of securement structure) that are used to adjoin the main body 102 and the trigger group body 140, via the main body 102, via at least one of the magazine adapters 160, or the like.

Overall functionality of a bolt catch is well known in the art. The bolt catch 200 disclosed herein that offers ambidextrous user interface operability operates in a conventional manner. More specifically, like prior art bolt catches, the bolt catch 200 disclosed herein is spring-biased to a retracted position (i.e., allowing the breech bolt to move to a battery position) and, in response to the magazine follower engaging member 206 being engaged by a spring-loaded magazine follower of a magazine following firing of a last round of ammunition in the magazine, moves to a deployed position (i.e., inhibiting the breech bolt to move to a battery position). Such movement to the deployed position results from a spring force of the magazine follower overcoming spring-bias force of the bolt catch 200 as the magazine follower moves up in the now empty magazine.

In response to the bolt catch 200 moving to the deployed position, forward motion of a breech bolt structure (e.g., the breech bolt structure 104 of the firearm 100 discussed above) after firing of the last round of ammunition in the magazine causes a surface of the breech bolt structure (e.g., a front face, or forward edge, or notch thereof or of a component thereof) to engage the bolt face engaging surface 214 of at least one of the legs 202. Such engagement of the breech bolt structure with the bolt face engaging surface 214 of at least one of the legs 202 inhibits the breech bolt structure from returning to its chamber closing position. Accordingly, the currently empty magazine can be replaced with a magazine containing one or more rounds of ammunition while the breech bolt structure 104 is retained rearward in a counter battery position by engagement with surface 214 of the bolt catch. Thereafter, via one or both of the user interface portions 204 of the bolt catch 200, a user can apply sufficient force on the bolt catch 200 for causing it to move from the deployed position to the retracted position. Such movement permits the breech bolt structure 104 to move back to its battery position and correspondingly stripping a round of ammunition from the magazine and chambering such round of ammunition.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm, comprising:

a monolithic main body including a central bore, an ammunition feed port, and a handguard, wherein the central bore extends between a front-end face at a front-end portion of the monolithic main body and a rear-end face at a rear-end portion of the monolithic main body and wherein an entire portion of the handguard is positioned between the ammunition feed port and the front-end face;

a breech bolt structure slidably disposed within the central bore, wherein the breech bolt structure and the central bore are jointly configured for enabling the breech bolt structure to be placed into the central bore through the front-end face; and a barrel attached to the monolithic main body, wherein a mounting portion of the barrel is engaged with the front-end portion of the monolithic main body.

2. The firearm of claim 1 wherein the monolithic main body further includes at least one exterior surface defining an accessory mounting structure.

3. The firearm of claim 1, further comprising:

a barrel fastener, wherein a main body engaging flange of the barrel is engaged with the front-end face and wherein the barrel fastener is fastened onto the front-end portion to secure the main body engaging flange of the barrel in engagement with the front-end face.

4. The firearm of claim 3 wherein the barrel fastener being fastened onto the front-end portion includes the barrel fastener being threadedly engaged with the front-end portion.

5. The firearm of claim 3 wherein the monolithic main body further includes at least one exterior surface defining an accessory mounting structure.

6. The firearm of claim 5 wherein:

the handguard includes a barrel fastener engaging portion extending therefrom;

the barrel fastener engaging portion defines the front-end face; and an entire portion of the handguard is positioned between the ammunition feed port and the barrel fastener engaging portion.

7. The firearm of claim 5, further comprising:

a barrel fastener, wherein a main body engaging flange of the barrel is engaged with the front-end face and wherein the barrel fastener is fastened onto the front-end portion to secure the main body engaging flange in engagement with the front-end face.

8. The firearm of claim 1 wherein a main body engaging flange of the barrel is engaged with the front-end face.

9. The firearm of claim 8 wherein:

the monolithic main body further includes at least one exterior surface defining an accessory mounting structure;

the handguard includes a barrel fastener engaging portion extending therefrom;

the barrel fastener engaging portion defines the front-end face; and an entire portion of the handguard is positioned between the ammunition feed port and the barrel fastener engaging portion.

10. The firearm of claim 1, further comprising:

a barrel fastener, wherein the barrel is engaged with a mating portion of the monolithic main body and wherein the barrel fastener is engaged with the mating portion of the monolithic main body to secure a mounting portion of the barrel in engagement with the monolithic main body.

11. The firearm of claim 10 wherein:

the mating portion of the monolithic main body is threaded; and the mating portion of the monolithic main body is integral with a front-end portion of the handguard.

12. The firearm of claim 10 wherein a main body engaging flange of the barrel is engaged with the front-end face.

13. The firearm of claim 12 wherein:

the mating portion of the monolithic main body is threaded; and the mating portion of the monolithic main body is integral with a front-end portion of the handguard.

14. The firearm of claim 12 wherein:

the mating portion of the monolithic main body is integral with a front-end portion of the handguard;

the mating portion of the monolithic main body defines the front-end face; and an entire portion of the handguard is positioned between the ammunition feed port and the mating portion of the monolithic main body.

15. The firearm of claim 10 wherein:

the mating portion of the monolithic main body extends from the handguard;

the mating portion of the monolithic main body defines the front-end face; and an entire portion of the handguard is positioned between the ammunition feed port and the mating portion of the monolithic main body.

16. The firearm receiver of claim 1, further comprising:

an anti-rotation structure receiving passage extending from an exterior surface of the monolithic main body at a central portion thereof to the central bore thereof.

17. The firearm receiver of claim 16 wherein the monolithic main body is a single piece of material.

18. The firearm receiver of claim 17 wherein the monolithic main body is one of machined from a metallic alloy material, injection molded from a polymeric material, and 3-D printed from a polymeric material.

19. The firearm receiver of claim 17 wherein the monolithic main body is one of machined from a metallic alloy material, injection molded from a polymeric material, and 3-D printed from a polymeric material.

20. The firearm receiver of claim 1 wherein the monolithic main body is a single piece of material.

21. A firearm receiver, comprising:

a barrel fastener engaging body;

a handguard attached to the barrel fastener engaging body, wherein the handguard extends from the barrel fastener engaging body to a central portion of the firearm receiver;

a central bore extending from the central portion of the firearm receiver to a rear-end portion of the firearm receiver; and an ammunition feed port having the central bore accessible therethrough, wherein an entire portion of the handguard is positioned between the ammunition feed port and the barrel fastener engaging body.

22. The firearm receiver of claim 21 wherein the firearm receiver is of a monolithic construction that includes exterior surfaces defining the handguard and an accessory mounting structure.

23. The firearm receiver of claim 21, further comprising:

an anti-rotation structure receiving passage extending from an exterior surface of the firearm receiver at the central portion thereof to the central bore thereof.

24. The firearm receiver of claim 23 wherein the firearm receiver is a single piece of material.

25. The firearm receiver of claim 24 wherein the firearm receiver is one of machined from a metallic alloy material, injection molded from a polymeric material, and 3-D printed from a polymeric material.

26. The firearm receiver of claim 21 wherein the firearm receiver is a single piece of material.

27. The firearm receiver of claim 26 wherein the firearm receiver is one of machined from a metallic alloy material, injection molded from a polymeric material, and 3-D printed from a polymeric material.

28. The firearm receiver of claim 27 wherein the firearm receiver is of a monolithic construction that includes exterior surfaces defining the handguard and an accessory mounting structure.

* * * * *